United States Patent [19]

Brown

[11] Patent Number: 5,024,244

[45] Date of Patent: Jun. 18, 1991

[54] ADJUSTABLE SCALP PROTECTION FOR HAIR DISCOLORATION

[76] Inventor: Kathleen L. Brown, 1004 2nd Ave. North, Onalaska, Wis. 54650

[21] Appl. No.: 452,708

[22] Filed: Dec. 19, 1989

[51] Int. Cl.[5] ..... A45D 19/18

[52] U.S. Cl. ..... 132/270; 132/208

[58] Field of Search ..... 132/208, 212, 270, 273, 132/274

[56] References Cited

U.S. PATENT DOCUMENTS

| | | | |
|---|---|---|---|
| 2,700,977 | 2/1955 | Necrup | 132/273 |
| 2,818,074 | 12/1957 | Mack | 132/270 |
| 2,957,480 | 10/1960 | Widoff et al. | 132/208 |
| 3,143,117 | 8/1964 | Ruud | 132/270 |
| 3,249,113 | 5/1966 | Sobeck | 132/270 |
| 3,270,753 | 9/1966 | Cook et al. | 132/270 |
| 3,390,689 | 7/1968 | Newman | 132/270 |
| 3,468,318 | 9/1969 | Cook et al. | 132/270 |
| 3,477,446 | 11/1969 | Terrenzio et al. | 132/208 |
| 4,020,854 | 5/1977 | Caruso | 132/208 |
| 4,289,150 | 9/1981 | Kimball | 132/270 |
| 4,357,951 | 11/1982 | Arrico | 132/270 |

FOREIGN PATENT DOCUMENTS

| | | | |
|---|---|---|---|
| 2481585 | 11/1981 | France | 132/270 |

*Primary Examiner*—John J. Wilson
*Assistant Examiner*—Frank A. LaViola
*Attorney, Agent, or Firm*—M. Paul Hendrickson

[57] ABSTRACT

The invention provides an adjustable protective scalpal covering device which enables a hair stylist to effectively treat selective hair strands with a discoloring reagent. The device includes a protective body portion sized so as to only partially cover the scalp and equipped with a plurality of orifices for withdrawing hair therethrough and a pair of straps extending outwardly from the body portion with means for variably adjusting and securing the device onto the patron's head. The size, construction, configuration and interrelationship between the component parts significantly enhance the efficacy, operational use and versatility of the device in hair discoloring treatments. The device may be inexpensively manufactured.

14 Claims, 2 Drawing Sheets

FIG. 1
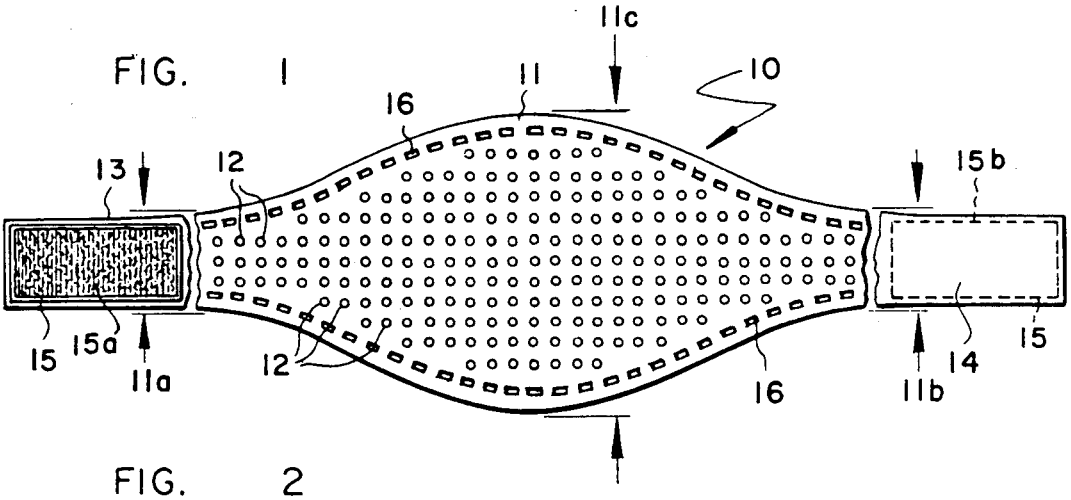
FIG. 2
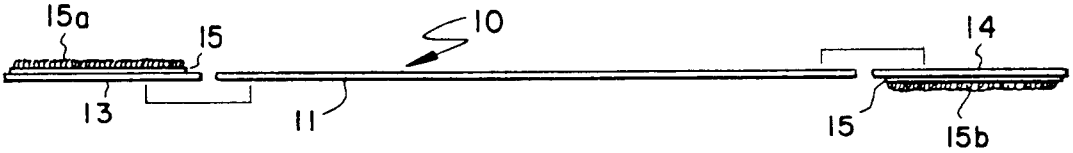
FIG. 3
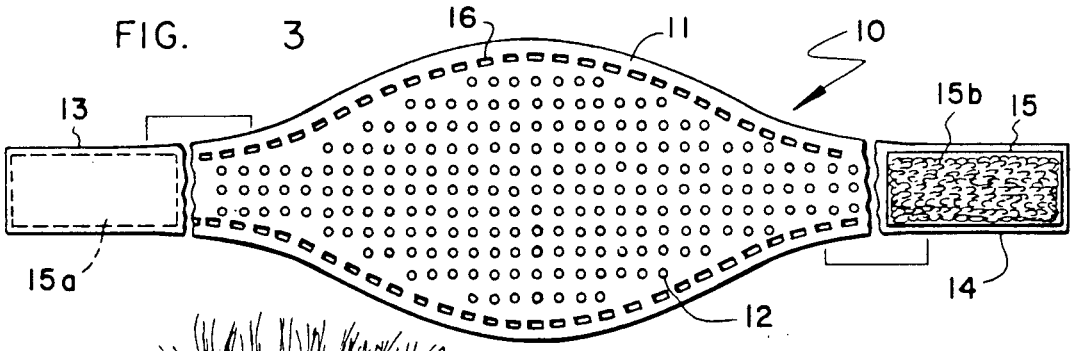
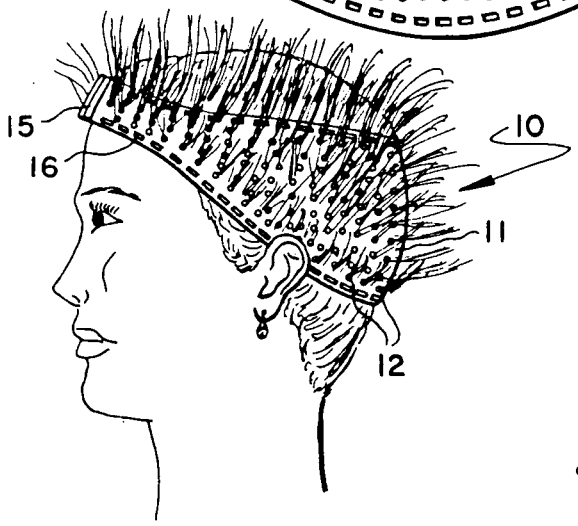
FIG. 4
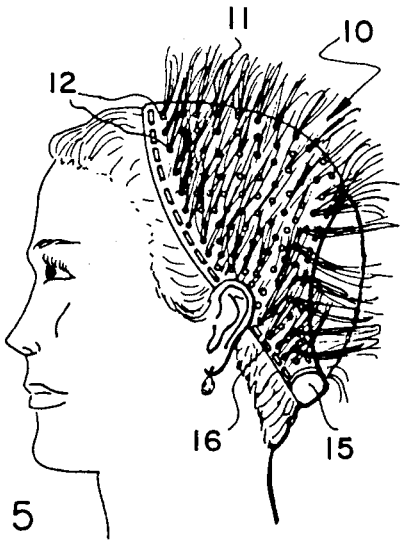
FIG. 5

ADJUSTABLE SCALP PROTECTION FOR HAIR DISCOLORATION

FIELD OF THE INVENTION

The present invention relates to a scalp protector and its use and more particularly to an adjustable protective covering and its use for the selective discoloration of hair strands.

BACKGROUND INFORMATION

It is conventional to use scalp protectors in hair coloring treatments in which certain selected hair strands are treated with hair discoloring reagents. These treatment techniques are often referred within the hair stylist or the beautician trade as "bleaching", "frosting", "streaking", "tipping", "accenting", "glazing", "haloing", "highlighting", "marbilizing", "naturalizing", "rainbowing", etc.

The practice customarily involves covering the scalp of a patron with a scalp protector containing a plurality of orifices for randomly withdrawing occluded hair strands located in the vicinity of the orifices through the orifices via a hooked instrument such as a crochet hook, and then chemically treating the withdrawn strands of hair.

The scalp protectors (as currently used by the trade) are generally designed to cover the entire scalp of the patron (reported as amounting to 120 square inches for an average American Caucasian female adult). When fitted with means of securing the protector onto patron's head, the protectors are typically equipped with chin straps. One of the most common practices is to use a rubber protector of a design similar to conventional elastomeric swimming cap having a plurality of orifices for hair strand withdrawal. The patron will assist the hair stylist throughout the hair treatment by pulling downwardly upon the lower outer lip of the scalp protector while the hair stylist withdraws and then treats the withdrawn strands. These elastic protectors are designed to be tightly drawn against the patron's scalp. Consequently, considerable matting of the hair, inability to withdraw the appropriate strands through the protector, discomfort pain and possible injury to the patron will occur. Moreover, the hair stylist cannot ascertain what the overall effect of treatment since withdrawal of the hairs is random and essentially completely occluded from the hair stylist's view.

In Kimball U.S. Pat. No. 4,289,150, there is disclosed a protective cover for dyeing selected locks of hair. The Kimball protective cover comprises an outer layer adapted to absorb excess liquid dye; a liquid impervious liner adapter for placement adjacent to the scalp, with the liner and outer layer being easily punctured to permit withdrawal of the locks, and the liner and outer layers being joined together and supplied as a flat piece that is foldable to fit a patron's scalp; and adhesive tabs to secure the folds of the cover after it is fitted on a patron's scalp. The design of this cover likewise envelopes the patron's entire scalp which renders the treatment random and occluded from the operator's view.

Mach U.S. Pat. No. 2,818,074 discloses a protective hair covering which is comprised of an inner and outer sheet of flexible material, with each sheet having a plurality of perforations therethrough; and means for securing said sheets together along marginal seams so that perforations of the inner sheet are offset with respect to the perforations of the outer sheet. The Mach protective hair covering is likewise designed to cover the entire scalp.

A still further full scalp protetive covering for use in hair curling is disclosed in Glick U.S. Pat. No. 2,575,589. The covering comprises a slitted perforated cap or pattern and an adjustable chin strap. The covering is used by placing the pattern over the head; drawing out portions of hair through slitted perforations in the pattern; applying a curler to the withdrawn hair portions; and removing the cap from the head by reinserting the curler and curled hair through the patterned perforations.

Another protective device proposed for the treatment of hair, disclosed in U.S. Pat. No. 3,143,117, comprises a plurality of triangular sections of absorbent material pivotally connected at common apex so that the sections may be fanned outwardly in a circular fashion for emplacement upon substantially all of the user's scalp. Neerup U.S. Pat. No. 2,700,977 describes a hair dress protector designed to protect waved or curled hair from subsequent displacement or disarrangement. The protector, consructed of foam rubber, is adjustable and fits over side portions of both the frontal and lower scalp regions.

SUMMARY OF THE INVENTION

The scalp protectors heretofore proposed inherently fail to possess the necessary design and construction for effective use in the selective discoloration of hair strands. Human head sizes and shapes are highly irregular due to factors such as ethnic, genetic, post- and pre-natal differences. Conventional hair protectors fail to universally match such irregular hair or scalpal configurations. The aesthetic effect of the treatment is highly dependent upon withdrawing precisely the appropriate hair strand grouping within a highly specific scalp region through the proper orifice and the judicious application of the appropriate discoloring reagent thereto to insure the accuracy and uniformity of the hair discoloration. The protective hair and scalp protectors proposed by the prior art, at best, permit the operator to randomly withdraw highly obscured hair strands for treatment. Consequently, the operator or stylist cannot accurately ascertain what hair strands will be actually withdrawn or treated or the over-all artistic impression and aesthetic effect of the treatment. Moreover, the construction and design of the prior protectors fail to provide the flexibility, ease of adaptation to the divergent head sizes and effective use so as to enable the hair preparer to obtain a consistent and uniform discoloration of selective hair strands. The existing protectors necessitate the highest order of artisan skill to provide the desired result which even the most skilled hair preparer have difficulty in achieving. A low cost protector which can be readily adjusted to match the scalp shape while also enabling the hair preparer to expeditiously discolor selective hair strands as required for the desired aesthetic effect would fulfill a long-felt need within the hair preparer art. The inventor has created an adjustable scalp protector which permits experienced artisans as well as laymen to overcome the aforementioned inherent prior art deficiencies and problems and to use such protectors in achieving the optimum aesthetic treatment while also alleviating the perils of injury or pain to the scalp.

BRIEF DESCRIPTION OF THE DRAWINGS

FIG. 1 is a top view of a protective covering device pursuant to the embodiments of this invention.

FIG. 2 is a side view of the protective covering device shown in FIG. 1.

FIG. 3 is a bottom view of the protective covering device shown in FIG. 2.

FIG. 4 is a view illustrating the protective covering device of FIG. 1 positioned upon the head of a patron.

FIG. 5 is another view illustrating the protective covering device shown in FIG. 1 in another position upon the head of the patron.

DESCRIPTION OF THE PREFERRED EMBODIMENTS

Figure 6:
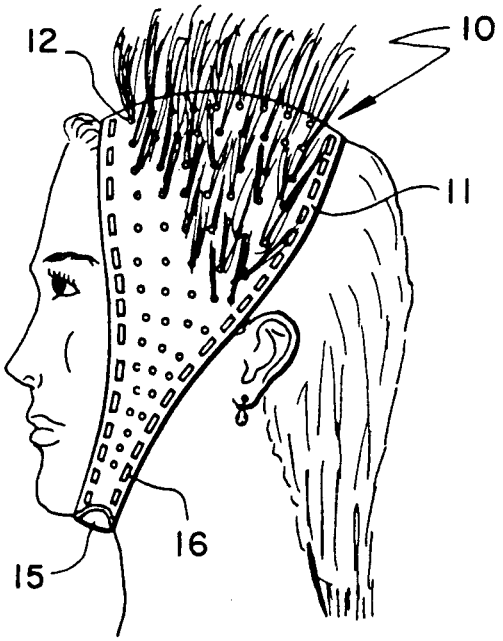
FIG. 6 is another view of the protective covering device shown in FIG. 1 repositioned and secured onto a patron's head in another protective region of the scalp.

The following description of the invention is referenced to the drawing wherein like parts are designated with like numerals throughout.

Referring to the Figures, and particularly FIGS. 1–3, the protective covering device (generally designated as 10) of this invention may be effectively used for the discoloring selective strands of scalpal hair. The covering device 10 generally comprises a protective body portion 11 sized so as to cover a partial portion of the entire scalpal region of a patron, a multiplicity of perforations 12 positioned within the protective body 11 for selectively withdrawing strands therethrough so as to permit the discoloration (e.g. bleaching or dyeing) of the withdrawn hair strands, a first appending strap portion 13 extending outwardly from said body portion 11 and a second appending strap portion 14 extending outwardly from said body portion 11 in an opposite direction from said first strap portion 13 with said first strap portion 13 and said second strap portion 14 in combination with said body portion 11 being of sufficient length to circumscribe the head of the patron, and means 15 for variably adjusting and securing the first strap portion 13 and second strap portion 14 in combination with said body portion 11 onto the head of the patron so as to permit said body portion 11 to circumscribally match the partial scalpal region covered thereby.

The configuration and structural characterstics of device 10 including the body portion 11 may be effectively utilized to advantage to alleviate many of the problems heretofore associated with the prior art protective covering devices. Although opaque construction materials may be used, a transparent body portion of sufficient transparency to allow the stylist to visually observe the covered hair will assist the stylist in more readily identifying the particular hair strands which should be withdrawn for treatment and to achieve the desired aesthetic effect. The use of transparent materials, however, will not singularly afford the unique manipulative characteristics and precision as afforded by the cooperative component combination of the protective device 10 herein. Conventional devices are generally designed to cover substantially the entire scalp and cause the covered hair to be tightly matted beneath the protective covering device. This renders it most difficult for the hair stylist to correctly withdraw for treatment the appropriate hair strands through the correct orifice site. The stylist is generally left to a random withdrawal without any manipulative means in such prior art devices to ascertain, assist or undertake corrective action (if needed) in withdrawing the appropriate hair strand selection. The present invention alleviates these prior art problems by providing a device which typically covers a partial portion of the scalp (as opposed to the entire scalp), applies the appropriate amount of pressure upon the covered hair within the working area (as opposed to the tightly biasing and matting the hair between the protector and scalp of conventional devices) and permits the operator to manipulatively withdraw with precision only those hair strands (as opposed to a random withdrawal) needed to produce the desired aesthetic treatment effect. If the operator should accidentally withdraw inappropriate hair strands, the present device allows for the operator's hands to be slid beneath the protective covering 10 and manually remove inappropriate withdrawn hair strands from any given orifice 12 without adversely disrupting the remainder of the work site on withdrawn hairs. The operator may also visually observe those hair strands actually hooked for withdrawal and manipulatively position only the desired hair strand grouping or locks for withdrawal through any given orifice 12. Should the operator, at any time, desire to check the progress of the selective hair strand withdrawal, the securing means 15 may be loosened, without causing a dislodgment of the withdrawn hair strands for direct viewing of the partially covered scalpal region.

Unlike conventional protective covering devices, the protective covering device 10 herein provides only partial coverage to the patron's scalpal region. This partial coverage permits a corresponding partial discoloration of the hair within sectional regions of the scalp such as within the upper frontal region (as illustrated in FIG. 6), the lower scalpal region (as shown in FIG. 4) and the more centrally disposed region as illustrated in FIG. 5. The partial coverage significantly enhances the operator's ability to effectively work within a localized region of the scalp.

In general, the protective device 10 herein is most appropriately adapted to protectively cover less than 60 per cent (e.g. less than 75 square inches) and advantageously only a minor portion (e.g. less than 60 square inches) of the total scalpal area of an average American Caucasian female adult. The body portion 11 contains a plurality of apertures 12 for the withdrawal of hair strands therethrough. Advantageously the body portion 11 will is provided with a perforated or perforatable surface area which affords coverage from about 15 to about 45 per cent of the total scalpal area of the patron. In the more limited embodiments of the present invention, the body portion 11 of device 10 affords partial coverage ranging from about 20 per cent to about 40 per cent of the total scalpal area of an average Caucasian adult female. A device 10 having a body portion 11 adapted to cover from about 25 per cent to about 35 percent (especially about $\frac{1}{3}$) of the total scalpal area have been found to be particularly effective. The total surface area of the scalp served by the body portion 11 (on a square inches basis) will generally range from about 10 square inches to about 60 square inches and advantageously from about 20 to about 50 square inches. In the more limited embodiments of the invention, the surface area coverage afforded by body portion 11 ranges from about 30 to about 45 square inches. This should be contrasted with conventional scalp protectors which generally cover substantially all of the patron's scalp and typically providing scalpal coverage more than 120 square inches.

Notwithstanding the wide variation in scalpal sizes and shapes; the width, length and configuration of the body portion 11 may be designed pursuant to the present invention so as to more uniformly match the contour of the patron's scalp. A more universal matching fit onto such divergent head sizes and configurations may be more effectively achieved by constructing the partial covering device 10 of a substantially flat and pliable material obliquely contoured about its outer periphery edge so as to uniformly mate onto the contour of the partially covered scalpal regions of the patron when the device 10 is adjustably secured to the patron's head. The surface area served by the body portion 11 is advantageously of an oval or ellipitical shape in which the outer periphery edges thereof (in relation to the bisecting longitudinal axis thereof) form a pair of accurately shaped sections tapering radially inwardly to their respective joinder onto straps 13 and 14. Consequently, the surface area will advantageously be wider in width along a perpendicular plane which bisects the major longitudinal axis portion 11 (e.g. passing through centroid) than those region bordering the distal portions (11*a* and 11*b*) of body portion 11. Such a tapered convex design allows the body portion 11 to more snuggly fit and universally match most patron's scalp when the straps 13 and 14 are drawn together and secured onto the patron's head. The body portion 11 may be of an elliptical, oval or other suitable curved shape so as to effectively provide the necessary protective coverage and contour mating onto the scalp. Alternatively, the body portion 11 and straps 13 and 14 may be of commensurate width or rectangular in shape (e.g. both the body portion 11 and the straps) or other appropriate configurations which will afford sufficient coverage to protect and partially envelope the patron's scalp. Excessive breadth within the body portion 11, however, tends to increase the manufacturing and material costs while also diminishing its over-all operational utility and aesthetic appeal. For most adaptations, the relative ratio of the more centrally disposed width 11*c* to the distal portions (11*a* and 11*b*) width of the body portion 11 is at least 4:3, advantageously at least 3:2, preferrably more than 2:1, and most preferrably a 3:1 ratio therebetween or more. The centrally disposed section of body portion 11*c* will normally be greater than about 3 centimeters (cm) and typically less than about 20 cm in width. For adaptation to most adult head sizes, the body portion 11 will advantageously range from about 5 cm to about 15 cm at its maximum width and preferrably from about 8 cm to about 12 cm in width.

The body portion 11 length (as measured along its major longitudinal axis) is likewise appropriately adapted to match the patron's head size and configuration. In the present device 10, the body portion 11 length along its major longitudinal axis may range from about 5 cm for highly localized adaptations to about 40 cm or more. The distal portions 11*a* and 11*b* of body portion 11 will advantageously range from about 1 cm to about 15 cm in width and preferably within about a 5 cm to 10 cm range. Advantageously, the body portion 11 length will range from about 15 cm to about 25 cm and preferably from about 20 cm to about 30 cm.

The thickness and flexibility characteristics of body portion 11 may be used to advantage to enhance the operative efficacy of device 10. The material used in the construction of the body portion 11 is generally characterized as being substantially inert and impervious to penetration of the discolorizing reagent while affording sufficient flexibility and strength to permit the body portion 11 to be drawn against the scalp and to mate onto the patron's scalp as illustrated in FIGS. 4–6. Illustrative construction materials for the body portion 11 include synthetic and natural materials such as fabrics (e.g. wool, cotton, silk, canvas, etc. treated or coated with an inert substance chemically resistant to decomposition and permutation by the discoloring agent), thermoplastic and/or thermoset materials, mixtures thereof, and the like. A relatively thin film material (e.g. less than about 10 mil in thickness and prescribly of one-ply material of less than 8 mil), substantially inert to the treating reagent and possessing sufficient tear resistance to prevent its structural damage under normal usage may be effectively used to manufacture a body portion 11 with appending straps 13 and 14 of a unitary construction. Elastic materials which cause the body portion 11 to compressively draw too tightly against the frontal scalp and inhibit effective manipulative withdrawal of hair strands (e.g. such as caused by conventional elastomeric bathing or swimming caps) are generally undesirable. Alternatively the more highly elastic material of a relatively low stretch-force resistance such as the thin elastomeric materials (e.g. about 0.5 mil thickness or less) currently used in surgical gloves, prophylactic devices, dental water dams, etc. may be used.

The configuration and design of the protective covering devices 10 permits it to be inexpensively manufactured from inexpensive plastics. The body portion 11 and the strap appendages (13 and 14) are advantageously of a unitary, one-piece, substantially flat construction in contrast to prior art devices which typically comprise either molded or multiple sections secured together in a poorly matching head size shape. Flexible thermoplastic films substantially free from elostomeric properties at 20° C. are particularly well suited as a raw material source. Such thermoplastic films typically exhibit melt and flow characteristics upon heating above the polymeric melting point but resolidify when cooled to a temperature below their respective melting points. Relatively inexpensive thermoplastics of sufficient thickness and structural strength to permit the body portion 11 and strap (i.e. 13 and 14) components herein to be manufactured as a single piece are readily available in a film form.

The one-piece unitary construction of the body 11 and straps 13 and 14 may be simulataneously stamped or scored from the thermoplastic film in a single stage processing step into the desired configuration and perforated structure therefore. A wide variety of compositionally, different thermoplastic films may be used for this purpose. Flexible thermoplastic films chemically inert to the hair discoloring reagents and possessing gas and/or liquid barrier properties are advantageously used in the fabrication of body portion 11. If desired, commercially available thermoplastic films precoated with protective coatings to further improve upon the chemical inertness and/or liquid or gas barrier properties of the film may also be used. In addition, the thermoplastic material should afford sufficient structural strength and resistance against rupturing or tearing. These stronger thermoplastic film materials will maintain structural integrity under operational usage and allow for a substantial reduction in film thickness. Although films measuring from about 0.5 to about 10 mil in thickness may be used, films which measure less than about 5 mils in thickness (e.g. about 1 to about 5 mils) and particularly those within about a 2 mil to about 4 mil thickness range may be used to advantage in the fabrication of the devices herein. Although generally unnecessary, a double ply of films secured about the outer periphery or intermittently secured together (e.g. such as by heat sealing or stitching) for purposes of providing an internal chemical reagent cavity trap may also be adapted to the design and construction of the present device.

Illustrative thermoplastic film materials include the polymerizates of vinyl aromatics (i.e. styrene; the meta- and para-methyl, ethyl, isopropyl, styrenes; sec- and t-butylstyrenes; p-heptyl and p-(2-ethylhexyl) styrenes, p-benzyl and p-cyclohexyl styrenes; mono and dymethoxy and ethyoxy styrenes as well as the alkyl and alkoxy substituted styrenes; alpha-methyl styrene and derivatives thereof, the halostyrenes (e.g. chlorostyrene, 2,5-dichlorostyrene), the cyano, carboxy-, hydroxy-, nitro and aminostyrenes, vinyl biphenyls), esters of the alpha-beta ethylenically unsaturated carboxylic acids such as the methacrylate and the acrylate esters of methyl, ethyl, isopropyl, and alpha-n-butyl, 2-ethylhexyl, hydroxymethyl, hydroxypropyl, etc.; ethylenically unsaturated carboxylic acid monomers, such as acrylic, methacrylic, itaconic, fumaric, maleic, crotonic as well as the esters thereof; the acrylonitriles and methacrylonitriles; the polyurethanes (e.g. condensation products of organic polyisocynate and a polyhydric such as 1,4 butanediol and/or polyhydric polyoxakylena others such as the polyethylene and polypropylene ether glycols; acrylamide and methacrylamides and corresponding N-substituted amides thereof (N-methyl, N-ethyl, N,N-diethyl, N-phenyl, N-methyl, N-phenyl, etc.); vinyl acetate and related monomers (e.g. chloro methoxy, diethyl, propionate, butyrate, acrylate, methacrylate, etc.); vinyl esters of aromatic acids (e.g. benzoate, alkoxybenzoates, etc.); the vinyl halides (e.g. vinyl chloride, vinyl bromide); vinylidene halides (e.g. bromide, chloride); mono and diethylenically unsaturated hydrocarbons such as ethylene, propylene, isobutylene, amylene hexene; isoprene, butadience, bicyloheptadienes, etc.; the alkyl, alicyclic and aralkyl vinyl ethers of methyl, ethyl, propyl, butyl, cyclohexyl, p-butylcychohexyl, phenyl, p-chlorophenyl, n-benzyl, nonyl, n-decyl, oleyl, etc., mixtures thereof and the like. THe polyolefines (e.g. polyethylene, polypropylene, etc.), the polyesters, polyvinylidene chlorides are representative thermoplastic filmed materials which generally exhibit sufficient heat scoring and sealing structural strength and chemical resistance to the most common hair discoloring reagent properties for adaptation to the construction of the body portion and, if desired, the one-piece body and appending straps (13 and 14) components thereto.

The manufactured body portion 11 (as provided to the consumer) does not necessarily require for the perforations 12 to be in the open aperature or orifice 11 form. If the body portion 11 is not provided with an open orficies, the body portion 11 is advantageously provided with a multiplicity of pre-determined systematic indexed set of markings thereupon so as to indicate to the operator an appropriate site for perforating the body portion 11. Techniques such as scoring, stamping, or otherwise weakening of the body portion structure sufficiently about the markings to enable the operator or ultimate consumer to readily puncture the desired apertured openings at an appropriate treatment site may be appropriately incorporated into the manufacture thereof.

The size and location of perforations 12 are provided within the body portion 11 to enable the operator to effectively treat the selectively withdrawn hair strands. The orifices as provided within body portion 11 should thus be of sufficient size to permit working and withdrawal of appropriate number of strands by conventional hair strand hooking devices or other suitable strand withdrawing instruments. The perforated structure or open orifices as provided within the body portion are most suitably provided in a circular or ellipical form. Excessively sized orifices (e.g. 5 mm or larger) are susceptable to uncontrolled discoloration whereas excessively small sized orifices (e.g. 0.05 mm or smaller) create difficulties in withdrawing the appropriate hair strands for treatment. For most adaptations, the orifice size will typically range from about 0.05 mm to about 3 mm and most typically range from about 1 to about 2 mm in diameter. Relatively small hooking apparatus such as a small sized crochet hook (e.g. No. 11 hook size measuring about 0.005 inch in diameter) are customarily used to hook and withdraw the hair strands through conventional protective covering orifices. Such conventional hooking apparatus may be used with the device 10, and if desired such hooking apparatus may be used to puncture or create the desired perforated structure within the body portion 11.

The location or index markings of the open orifice 12 sites within the body portion 11 should likewise be spaced apart sufficient to provide the desired discoloration effect to avoid inadvertent hair discoloration. The average distance between adjacent orifices will normally be greater than about 4 mm except for certain specialized discoloring styling (e.g. clustering, etc.) in which a more tightly discoloring arrangement may be desirable. For most discoloring adaptations, the adjacently positioned perforations will usually be spaced at a distance ranging from 0.5 cm to about 4.0 cm and preferrably spaced apart at a distance ranging from about 1 cm to about 2 cm.

During the operational use of the device, those regions bordering onto the working orifices and the outer protective covering perimeter are normally subjected to more stress and strain than the non-bordering or non-working portions of the protective covering device. These regions may be appropriately strengthened so as to render the device more durable against wear and tear. For example, if thermoplastic materials are used as the fabricating material for appending straps (13 and 14) and body portion 11, the outer perimeter of the body portion 11 and orifice 12 bordering edges may be reinforced through conventional fabricating or scoring techniques. These boundary areas may be subjected to reinforcing heat treatments to biaxially orient or facilitate thermoplastic material deposition or stengthening thereof along the tear prone bordering regions (e.g. such as stamping or scoring under heat sealing conditions). The heat treatment converts the thermoplastic into a molten mass which upon cooling and resolidification contributes towards added structural strength thereto. Stamping or scoring techniques under heat sealing conditions which effectuate a compositional or physical strengthening of the heat treated regions may thus be used to advantage in the manufacture of the device. Alternatively, overlapped and heat sealed thermoplastic materials, stitchings, as illustrated in the Figures or stitched materials may be effectively utilized for reinforcement.

Straps 13 and 14 and the means 15 for variably adjusting and securing straps 13 and 14 together may be provided in a variety of forms. Appending straps (13 and 14) of body portion 11 extend the over-all length of the device. The appending straps (13 and 14) are advantageously provided in a form of a lesser width than the body portion so as to allow the straps (13 and 14) to snuggly fit against the temples and below the occipital of the patron's head. As illustrated in FIG. 5, straps 13 and 14 may be appropriately tapered inwardly from the body portion 11 for securance to the rear of the patron's head below the occipital. To a lesser advantage, the appending straps 13 and 14 may comprise draw strings of a relatively flexible, thin plastic material which may then be suitably drawn and tied together. A continuous elastic band secured to the ends of body portion 11 with sufficient length and elasticity to stretch over the patron's occipital and draw body portion 11 snuggly against the scalpal region of the patron may be alternatively used. The means 15 for securance of strips 13 and 14 advantageously comprises a plurality of knobbed or hooked male projections and correspondingly oppositely positioned mating female orifices or loops for interlocking engagement thereof such as conventionally used in the construction of variably adjustable head size sport caps, buckles, hooks, etc. A particular suitable securing means 15 (as illustrated in the Figures) involves fitting straps 13 and 14 with a hook and napped loop combination such as disclosed in U.S. Pat. No. 4,386,642. This particular fastening combination may be generally adapted to the present device by fitting one of the plastic straps containing a multitude of plastic hook fasteners 15*b* of the combination while the other interfacing strap portion when looped about the patron's head is fitted with a plastic napped material 15*a* contains a multitude of frayed plastic projections for operative fastening engagement onto the napped hook. When the plastic hooked projecting material 15*b* is pressed firmly against the napped plastic material 15*a*, the fastening combination remains securely and firmly bound to one another until released by the operator. This particular combination affords a means for variably adjusting the covering device to match the patron's head size. The site at which the fastening combination is compressively joined together provides a means whereby the device may be fitted to match the circumferential head size of the patron. The secured straps (13 and 14) may easily be released from the patron's head by simply pulling one of the straps upwardly and away from the other strap. Such a fastening combination is commercially readily available (e.g. velcro, manufactured and distributed by Minnesota Mining & Manufacturing Co., 3M Center, St. Paul, Minn. 55144) in a form wherein the reverse surfaces of the interlocking hooked projections 15*b* and napped projections 15*a* include a pressure sensitive adhesives for adhesively securing and bonding the respective fastening components onto the straps 13 and 14. The positioning of the hook 15*b* and nap 15*a* fastening combination or other variably adjustable means for securing straps 13 and 14 will generally be sufficient to provide a circumferential arc ranging from about 35 cm to about 65 cm and advantageously a circumferential arc measuring from about 45 cm to about 60 cm being most typically adaptable to most adult female head sizes. On a commercial basis the covering 10 may be sized to fit head sizes ranging from about 45 cm to about 60 cm adjustable range and most typically of about 50 cm to about 55 cm.

The present invention also affords an improved method for the discoloration of selective hair strands of a patron. This improved method generally comprises:

a) providing a protective covering device 10 comprised of a body portion 11 of a sufficient surface area to effectively cover a minor portion of the total scalpal region of a patron, a plurality of orifices 12 positioned throughout the body portion 11 with said orifices being of a sufficient size and location to permit the selective withdrawal of hair strands therethrough for treatment with a hair discoloring reagent and means for circumferentially securing the device onto the head of the patron;

b) adjustably securing the device upon the head of the patron so that the body portion of the device effectively covers a partial portion of the scalpal region of the patron to be subjected to discoloration;

c) selectively withdrawing strands of hair from the scalp of patron through the orifices of said body portion; and d) treating the selectively withdrawn strands of hair with a hair discoloring reagent.

The present invention affords an inexpensive method and device for selectively discoloring hair strands. The device may be, if desired, discarded after its use without materially affecting the cost. The device significantly assists the person or operator in achieving the desired aesthetic effect while minimizing the labor and time costs. The device also enables the less skilled stylist to expeditiously obtain (with uniform consistency) results which only the most gifted artisans would expect to achieve.

FIGS. 4–6 illustrate the versatility and universal application of the present device 10 and especially as it relates to the more difficult hair treatments. FIG. 6 depicts the protective device 10 emplaced onto the frontal and upper portion of the patron's scalp with overlappingly straps 13 and 14 drawn tightly about the patron's chin and secured together by securing means 15 such as an interfacing hooked and napped combination so as to fit snuggly onto and match the particular head size and configuration of the patron. In the event the hair stylist desires to rearrange the covered hair strand positioning or manipulatively assist in the precise selection of the particular hair strands to be withdrawn through any given aperture 12, the design and configuration of device 10 permits the stylist to place his or her fingers beneath the body portion 11 about its entire periphery and manually work the desired hair strands to the precise aperture 12 as may be required for the desired stylistic effect. FIG. 5 depicts the device 10 repositioned and secured onto the patron's scalp so as to allow for treatment of the upper, temporal and a portion of the scalpal region of the patron. In FIG. 5, overlapping straps 13 and 14 are secured below the patron's occipital. As illustrated in FIG. 5, the repositioning of device 11 has not substantially altered the conformity by which the device 10 mates onto the contour and configuration of the patron's head.

FIG. 4 further reveals how the device may be effectively utilized in the treatment about the patron's occipital scalpal region by centering the body portion 11 upon the occipital region and securing appending straps 13 and 14 about the patron's forehead. Similar to the illustration revealed by FIG. 5, the body portion 11 as depicted in FIG. 5 similarly rests uniformly flush against the patron's scalp. The overall combination and cooperative association between the component parts of the device allow the device to be positioned and secured about the entire scalpal region in uniform conformity therewith for optimum hair treating efficacy. Accordingly, if desired, the main body portion in FIG. 4 may be repositioned to treat the scalpal base and secured about the upper frontal region of the scalp. Thus, the device may be secured at a multitude of securing sites for the treatment of any desired scalpal region.

One of the most challenging tasks confronting even the most skilled hair stylist is to achieve a "natural" dark hair coloring effect upon a bleached head of hair. In a normal head of dark hair, the darker hair tints occur about the base or lower scalpal regions with a gradient lighting in hair coloring occuring about the upper frontal and forehead regions of the scalp. This lightening effect normally arises because of the more direct exposure of this scalpal region to the sun rays. The hair stylist desires to achieve this natural tinting effect in the restoration of bleached hair to its natural hair color.

The normal tinting procedure with conventional devices is to cover the entire scalp and randomly withdraw hair strands within the vicinity of the orifices. The experienced stylist will typically encounter difficulties in selectively withdrawing only the desired hair strand bundles thorugh any given orifice and an inability to undertake corrective action for insuring that the appropriate strands or all of the required hairs have been withdrawn through the protective covering orifices. The problem is further compounded in conventional devices by the excessive or non-uniform force applied onto the covered hair, the lack of conformance to the patron's head size and configuration. After completing the withdrawn hair treatment and removing the protective covering device, the hair stylist will often observe a substantial number of untreated hair strands which arise because of an inability to withdraw all of the hair strands through the protective covering orifices. Moreover, a significantly greater portion of the treated hair strands will typically exhibit a bleached hair stem, a hallowing effect about the area serviced by the respective orifices and discolored hair strand portions more outwardly removed from the orifice site. The resultant bleached, hallowing and darkened hair coloring effect fails to reflect the desired natural hair treatment. This problem is generally attributable to the failure of the prior art devices to match the size and configuration of the patron's head, inappropriate and non-uniformity in pressure as applied by the device onto the covered hair, and the inability to selectively and completely withdraw the hair strand bundles through the proper orifices.

The device 10 of this invention allows the hair stylist to more easily and effectively accomplish a natural hair treatment through a plurality of staged sequences. With reference to FIGS. 4–6, this treatment may be effectively accomplished, for example, by intially positioning the device 10 upon the scalp as illustrated in FIG. 4. The flexibility, transparency, the uniform or snug fit of the device under the appropriate tension upon the scalp and the ability of the hair stylist to manipulatively work underneath the protective covering 10, thereby allows the hair stylist to selectively withdraw only the desired hair strands through the appropriate apertures 12 and properly treat the withdrawn strands with the discoloring reagent. Hair strands incompletely withdrawn in the vicinity of the ear lobes commonly arising with the conventional devices may be effectively alleviated by the device 10 of this invention. The current device 10 may be designed so as to permit the device to be placed about the ear lobes as opposed to the positioning over the ear lobes of conventional devices. Upon completion of the discoloration of the hair strands as illustrated by FIG. 5, straps 13 and 14 may be disengaged and the device 10 then repositioned and secured onto the patron's scalp as depicted in FIG. 6. The hair strands may be similarly uniformly withdrawn through the protective covering, gradiently treated with the desired reagent to the desired discoloring effect, followed by a disassemblage, repositioning of the device 10, engagement and withdrawal of hair strands therethrough as depicted in FIG. 5. Such a graditional hair treatment with the device 10 of this invention, thus permits the hair stylist to effectively achieve a more natural hair darkening treatment than may be accomplished with the existing protective covering devices.

The particular device 10 as depicted in FIGS. 1 and 3–6 also reveals a plurality of rectangular heat sealing score marks 16 which arise as the result of overlapping onto the underside a small margin of the thermoplastic body portion 11, appending straps 14 and 15 abut the outer periphery of the device 10 and heat sealing the overlapped thermoplastic portions thereof together for reinforcement purposes.

I claim:

1. A protective covering device for partially covering the scalpal hair of a patron and selectively discoloring hair strands therewith which device comprises a substantially flat, thermoplastic body portion sized so as to partially cover a portion of the scalpal region of a patron, a multiplicity of indices throughout the body portion for providing an indexed body for the selective withdrawal of hair strands therethrough and the discoloration thereof, a first appending strap portion extending outwardly from said body portion and a second appending strap portion extending outwardly from said body portion and oppositely to said first strap portion, said first strap portion and said second strap portion in combination with said body portion being of sufficient length to circumscribe the head of the patron, and means for variably adjusting and securing together the first strap portion and second strap portion about the head of the patron.

2. The protective covering device according to claim 1 wherein the body portion, first strap portion and second strap portion are comprised of a thermoplastic film of a unitary and a substantially flat construction.

3. The protective covering device according to claim 2 wherein the body portion is of sufficient surface area so as to provide a protective scalpal coverage to a minor portion of the total scalpal area of the patron.

4. The protective covering device according to claim 2 wherein the multiplicity of indices throughout the body portion comprise indices selected from the group consisting of open orifices and precursor orifices wherein the thermoplastic film bordering onto the precursor orifices have been sufficiently weakened so as to permit the formation of an open orifice of a predetermined size by the puncturing thereof, with said open orifices and said precursor orifices defining a diameter of said orifices ranging from about 0.05 mm to about 2 mm.

5. The device according to claim 4 wherein the means for variable adjusting and securing the device onto the head of a patron comprises mating fastener members consisting essentially of two mating bands for securing and fastening together which members when compressed together form a securing body therebetween and when said members are pulled apart will permit the release of the bond therebetween.

6. The device according to claim 5 wherein body portion is of an elliptical shape which affords coverage ranging from about 20 per cent to about 40 per cent of the total scalpal surface area of a patron.

7. The device according to claim 6 wherein the body portion is constructed of a thermoplastic film which possess sufficient transparency to visually observe the hair strands protectively covered thereby.

8. An improved method for the discoloration of selective hair strands of a patron which comprises:

a) providing a protective covering device comprised of a substantially flat, thermoplastic body portion of a sufficient surface area to effectively cover a minor portion of the total scalpal region of a patron, a first strap portion and a second strap portion extending outwardly in opposite directions from said body portion, a plurality of orifices of a sufficient size and location throughout the body portion to permit the selective withdrawal of hair strands therethrough and the treatment of the withdrawn hair strands with hair discoloring reagent and means for circumferentially securing said first strap portion and said second strap portion onto the head of the patron so that the device matches the head size of the patron;

b) adjusting and securing said means onto the head of the patron so that the body portion thereof effectively covers a partial portion of the scalpal region of the patron for hair discoloration;

c) selectively withdrawing strands of hair from the scalp of patron through the orifices of said body portion; and d) treating the selectively withdrawn strands of hair with a hair discoloring reagent.

9. The method according to claim 8 wherein the body portion, first strap portion and second strap portion are comprised of a thermoplastic film of a unitary and substantially flat construction.

10. The method according to claim 9 wherein the means for securing the device onto the head of a patron consisting essentially of two mating fastening bands which bands when compressed together form a securing bond therebetween and when said bands are pulled apart effectuate a separation and release of the bond therebetween.

11. The method according to claim 10 wherein the body portion is of an elliptical shape which affords coverage ranging from about 20 percent to about 40 percent of the total scalpal surface area of a patron and the body portion is constructed of a thermoplastic film which posses sufficient transparency to visually observe the hair strands protectively covered thereby.

12. The method according to claim 11 wherein method includes a plurality of treatments of selectively withdrawn hair by the repositioning of the body portion onto different scalpal regions of the patron.

13. The method according to claim 10 wherein the fastening bands are secured onto the scalpal region below the occipital region of the patron.

14. The method according to claim 11 wherein the method includes the additional steps of removing the device from readjusting and securing said means onto the head of the patron so that the body portion thereof effectively covers an untreated portion of the scalpal region of the patron for hair discoloration; selectively withdrawing strands of hair from the scalp of patron through the orifices of said body portion; treating the selectively withdrawn strands of hair with a hair discoloring reagent; and removing the device from the patron.

* * * * *